US008714549B2

(12) United States Patent
Nishimura

(10) Patent No.: US 8,714,549 B2
(45) Date of Patent: May 6, 2014

(54) POST-PROCESSING DEVICE

(71) Applicant: KYOCERA Document Solutions Inc., Osaka (JP)

(72) Inventor: Jun Nishimura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 13/627,087

(22) Filed: Sep. 26, 2012

(65) Prior Publication Data

US 2013/0082434 A1 Apr. 4, 2013

(30) Foreign Application Priority Data

Sep. 30, 2011 (JP) ..... 2011-216691

(51) Int. Cl.
*B65H 5/04* (2006.01)

(52) U.S. Cl.
USPC ..... 271/275; 271/303; 271/186

(58) Field of Classification Search
USPC ..... 271/225, 275, 291, 301, 303, 302, 271/184–186; 399/364; 242/528
See application file for complete search history.

(56) References Cited

U.S. PATENT DOCUMENTS

2006/0103065 A1 5/2006 Kotani
2007/0069452 A1 * 3/2007 Murata et al. ..... 271/186

FOREIGN PATENT DOCUMENTS

JP H03-107454 U 11/1991
JP 05330714 A * 12/1993 ..... B65H 29/60
JP 11-011771 A 1/1999
JP 2006-143339 A 6/2006

OTHER PUBLICATIONS

Machine translation of JP 5-330714.*
Notice of Reasons for Rejection issued to JP Application No. 2011-216691, mailed Dec. 4, 2013 (with partial translation).

* cited by examiner

*Primary Examiner* — Michael McCullough
(74) *Attorney, Agent, or Firm* — Knobbe Martens Olson & Bear LLP

(57) ABSTRACT

A post-processing device includes a cylindrical body and branching guides. The cylindrical body is rotatable. The cylindrical body and the branching guides convey paper to a processing unit that processes the paper and to an ejection tray. A paper reversing mechanism is composed mainly of the cylindrical body and the branching guide, in which a first face of the paper is directed to a peripheral surface of the cylindrical body and the paper is wound therearound by rotating the cylindrical body. The paper reversing mechanism then rotates the cylindrical body in a reverse direction and switches the posture of the branching guide, to thereby separate the paper from the peripheral surface and eject.

5 Claims, 11 Drawing Sheets

POST-PROCESSING DEVICE

This application is based on and claims the benefit of priority from Japanese Patent Application No. 2011-216691, filed on 30 Sep. 2011, the content of which is incorporated herein by reference.

BACKGROUND

The present disclosure is related to a post-processing device that performs post-processing of a sheet-shaped printing medium such as paper onto which an image is formed by an image forming apparatus such as a copier and a printer.

In recent years, a digital multifunction peripheral (MFP) having not only a printing function but also a copying function, a facsimile function and the like is widely used as an image forming apparatus. Addition of various functions and improvements are being made to the MFP for providing increased convenience to users. An example of the functions is a paper reversing device installed in an image forming unit of the MFP for continuous printing of images (image formation) on both faces of a sheet of paper.

Basically, the paper reversing device has a paper inlet path, a feed roller pair, and a paper outlet path. The feed roller pair is composed of a reversing roller with a greater diameter and an auxiliary roller with a smaller diameter. The reversing roller and the auxiliary roller constituting the feed roller pair can rotate in forward and reverse directions while pressing against each other. The paper inlet path is directed toward between the reversing roller and the auxiliary roller and terminates at the vicinity of a contact point therebetween. An introduction opening of the paper outlet path is located close to an outer periphery of the reversing roller, not at the contact point. The paper outlet path is configured to extend in a tangential direction of the outer periphery.

In the paper reversing device thus configured, paper that is conveyed in the paper inlet path toward the feed roller pair is interposed between the reversing roller and the auxiliary roller, and then wound around the reversing roller rotating in one direction (conveyance direction). And then, when a rear end of the paper reaches a point immediately before the introduction opening of the paper outlet path, the reversing roller starts rotating in a reverse direction. The paper that is wound therearound is thus conveyed toward the paper outlet path with the rear end directed forward.

As is apparent from the above description, a top face of the paper upon introduction is directed downward upon ejection, thereby reversing the paper. The paper reversing device reverses the paper by winding the paper around the reversing roller. In such a configuration, the space occupied by the paper reversing device can be reduced and size of an entire printing apparatus can be reduced.

The paper reversing device allows continuous printing on both faces of the paper. In general, the paper onto which an image is formed by an image forming apparatus such as MFP is ejected with a printed face directed downward, in a state so-called "face-down". However, a user may wish to eject the paper with the printed face directed upward, in a state so-called "face-up". Face-up ejection of the paper is made possible by installing the paper reversing device in the image forming apparatus main body. Alternatively, face-up ejection of the paper is made possible also by installing the paper reversing device in a post-processing device (if any) connected to the image forming apparatus main body that performs a punching process on printed paper, a stapling process on a stack of sheets of paper, and the like.

However, installing the paper reversing device in, for example, the post-processing device only for realizing the face-up ejection, in addition to a normal face-down ejection of the paper on which an image is formed and output by the image forming apparatus, involves increased cost and increased space occupied inside the apparatus.

SUMMARY

The post-processing device according to the present disclosure for solving the abovementioned problems includes at least an evacuation drum, a first branching guide, a first driving unit, and a control unit. The evacuation drum is rotatably supported by a main shaft and rotates in a first direction to wind a sheet-shaped body around a peripheral surface thereof.

The first branching guide has a substantially triangle shape of which base faces the drum, and is rotatably supported at a position more on outside than the base in a radial direction of the evacuation drum by a shaft parallel to the main shaft. In this state, an apex of the first branching guide on an upstream side in a winding direction of the evacuation drum and an apex of the first branching guide on a downstream side in the winding direction of the evacuation drum can be in contact with and separated from the peripheral surface of the evacuation drum by rotation of the first branching guide. In addition, the first branching guide forms a gap from the evacuation drum through which the sheet-shaped body can pass when the apexes are separated from the peripheral surface of the evacuation drum. The first driving unit rotationally moves the first branching guide and rotates the evacuation drum.

The control unit controls the first driving unit. More specifically, the control unit controls to perform the following. In response to an instruction to reverse the sheet-shaped body, the first driving unit is controlled such that: the gap is formed between the first branching guide and the evacuation drum; the evacuation drum rotates in the winding direction; the sheet-shaped body passes through the gap and is wound around the evacuation drum. Thereafter, the apex of the first branching guide on the downstream side in the winding direction is in contact with the peripheral surface of the evacuation drum; and the evacuation drum rotates in a counter-winding direction. The sheet-shaped body is thus separated from the evacuation drum; and the sheet-shaped body is ejected with a face, which is opposite to a top face upon winding, directed upward.

DETAILED DESCRIPTION

An embodiment of the image forming apparatus according to the present disclosure is described hereinafter with reference to the drawings. It should be noted that the present embodiment described herein is a mere example of implementation of the present disclosure, and in no way restricts the technical scope of the present disclosure.

Figure 1:
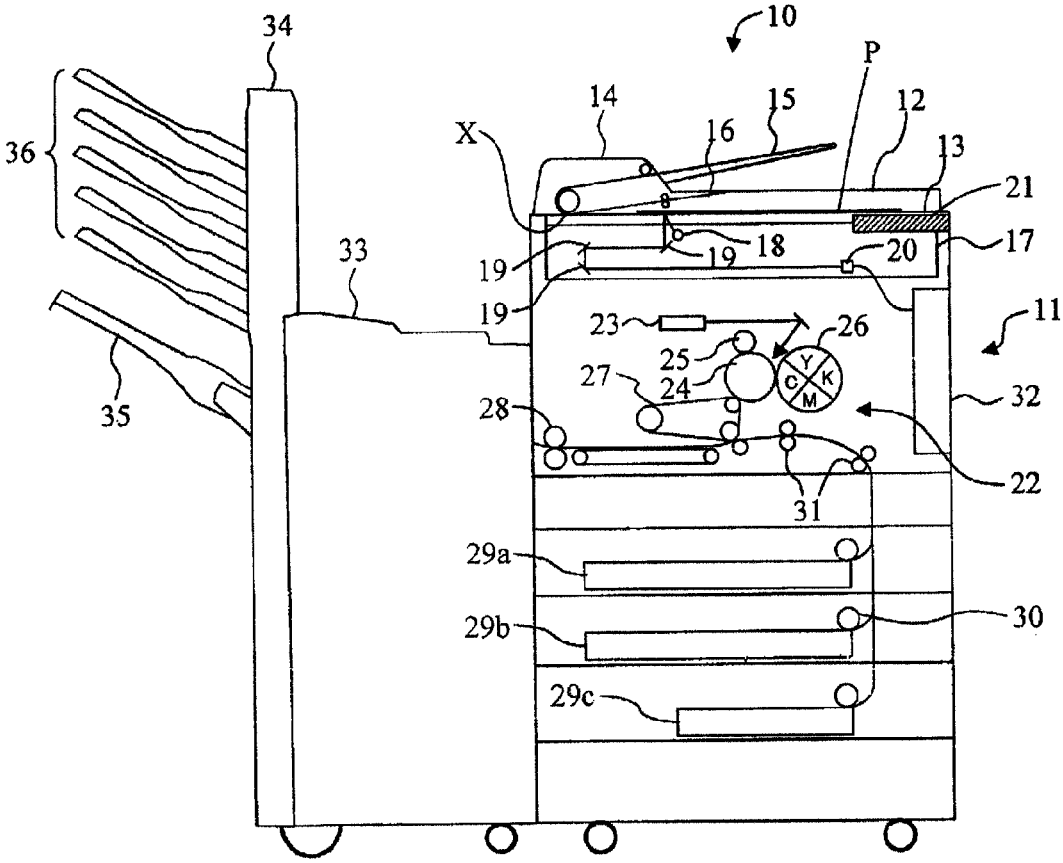
FIG. 1 is a conceptual diagram showing an example of an overall internal configuration of an image forming apparatus provided with a post-processing device according to the present disclosure.

FIG. 1 is a conceptual diagram showing an example of an overall configuration of an image forming apparatus provided with a post-processing device according to an embodiment of the present disclosure, especially an internal configuration of the image forming apparatus. In FIG. 1, details of each component not directly related to the present disclosure are omitted. An image forming apparatus may have a variety of functions. The apparatus shown in FIG. 1 is supposed to be a digital multifunction peripheral 10 having functions of print, copy, scan, facsimile and the like.

The digital multifunction peripheral as shown in FIG. 1 operates as a copier and has an image reading unit for an original image including text, figure and the like. When copying an original P using the multifunction peripheral 10, for example, a user places the original P on a light transmissive platen 13 or a document tray 15 shown in FIG. 1. The user then inputs conditions for copying and makes an instruction for printing through an input/display unit 21 disposed near the platen 13. The input/display unit 21 is disposed horizontally in front of the platen 13 when viewed from the user operating the multifunction peripheral 10.

Through the input/display unit 21, the user inputs a setting condition for image reading and image formation, in other words printing, of the original P; an instruction for processing; and the like. The input/display unit 21 displays the setting condition and instruction thus input, a message as a response thereto and the like on a touch screen, for example.

In response to the instruction for printing from the input/display unit 21, components (mechanically driven components) start operating. As shown in FIG. 1, the multifunction peripheral 10 includes an image forming apparatus main body 11 and a platen cover 12. The platen cover 12 is attached to an upper portion of the main body 11. The platen 13 is disposed on an upper surface of the main body 11. The platen 13 is opened and closed with the platen cover 12. The platen cover 12 is provided with an automatic document feeder 14, the document tray 15, and a paper ejection tray 16.

When the original is placed on the document tray 15, not on the platen 13, for copying of the original, the automatic document feeder 14 introduces the original into a paper path one by one, lets the original pass through an original reading position X, and then ejects the original to the paper ejection tray 16. While passing through the original reading position X, the original is read by the image reading unit 17 provided below the platen 13.

The image reading unit 17 is composed mainly of a light source 18, various mirrors 19, an image data generating unit 20. The light source 18 irradiates the platen 13 from below and has a shape elongated in a so-called main scanning direction. The various mirrors 19 guide light corresponding to an original image, incident from the platen 13. The image data generating unit 20 receives the light guided by the various mirrors 19, converts the light into an electrical signal, and performs image processing and the like as necessary.

In the image forming apparatus main body 11, an image forming unit 22 for printing image data is provided below the image reading unit 17. The image data that can be printed by the image forming unit 22 is not limited to that generated by the image data generating unit 20 described above. Recently, the multifunction peripheral 10 is configured to be connected to a network such as a LAN. The image data that can be printed by the image forming unit 22 generally includes image data received by the multifunction peripheral 10 from a user terminal device such as a personal computer (PC) included in the network.

The printing method employed by the image forming unit 22 is the xerographic method. The xerographic method is a method of: forming a latent image on the photoreceptor drum 24 by charging the photoreceptor drum 24 evenly by a charging device 25 and then irradiating the photoreceptor drum 24 by a laser irradiator 23; forming a visible image by attaching a toner by a developing device (rotary developing device) 26; and transferring the visible image to a transfer medium using a transfer roller.

In a multifunction peripheral that can process full-color image, the developing device 26 rotates and developing units containing toners of respective colors are arranged to face the photoreceptor drum 24. In this state, a latent image on the photoconductor drum 24 is developed by the toners contained in the developing device 26, and is transferred onto an intermediate transfer belt 27. In such an image forming apparatus, the developing device 26 includes four developing units 125(Y), 125(C), 125(M), and 125(K) respectively containing toner of yellow (Y), cyan (C), magenta (M), and black (K). By performing the transfer to the intermediate transfer belt 27 for each color, a full color image is formed on the intermediate transfer belt 27.

A sheet-shaped transfer medium, for example printing paper, onto which the full color image thus formed is printed, is placed in paper feeding cassettes 29*a*, 29*b* and 29*c*. Upon printing by the image forming unit 22, a sheet of the transfer medium is picked up from any one of the paper feeding cassettes by a pick-up roller 30, and then fed to the intermediate transfer belt 27 by a feeding roller 31 and the like. The image forming unit 22 transfers the visible image on the intermediate transfer belt 27 onto the transfer medium and feeds the transfer medium by a conveyance belt to a fusing unit 28 (fusing device) for fusing the visible image. As the fusing unit 28 heats and pressurizes the transfer medium, the visible image is fused onto the transfer medium.

After the transfer and fusion of the visible image, the transfer medium with an image printed on a surface thereof is ejected from the image forming apparatus. The transfer medium (sheet-shaped body) having a sheet-like shape is generally paper. Therefore the transfer medium is simply referred to as "paper" hereafter.

On a left side of the main body 11 of the image forming apparatus and a paper feeding cassette unit composed of the paper feeding cassettes 29*a*, 29*b* and 29*c*, a post-processing device 33 is disposed in combination especially with the image forming apparatus main body 11. The printed paper ejected from the image forming unit 22 is fed into the post-processing device 33. The post-processing device 33 according to the present embodiment shown in FIG. 1 has functions of: forming a plurality of holes for filing on the paper fed from the image forming apparatus (punching); stapling for binding a stack of paper; and the like.

The post-processing device 33 includes a main tray 35 and a plurality (five in FIG. 1) of multi-job trays 36 that are supported by a support pole 34 attached to a main body of the post-processing device 33. The main tray 35 is a default tray used for receiving the ejected paper in a case in which no specific ejection target is specified. On the other hand, the multi-job trays 36 are used for sorting and ejecting the paper, onto which an image is printed by the image forming apparatus, in a divided manner according to a predetermined rule. Given this, the post-processing device 33 also has a paper sorting-feeding function.

A control circuit unit 32 is provided in the main body 11 of the image forming apparatus. The control circuit unit 32 is composed of: a CPU (central processing unit); various storage devices; an interface for communication with a user terminal device such as a personal computer (PC) connected to the image forming apparatus via a network; and the like. The control circuit unit 32 stores various control programs, information and data for operating the image forming apparatus, and controls drive of an input/display unit 21, the image reading unit 17, and the image forming unit 22. The control circuit unit 32 also includes a control unit that controls drive of the post-processing device 33 and controls a plurality of paper feeding modes in the post-processing device 33. A drive control unit of the control circuit unit 32 that controls drive of the post-processing device 33 is a constituent of the post-processing device 33. Alternatively, the drive control unit of the post-processing device 33 can be configured with a circuit separated from the control circuit unit 32 and can be provided in the post-processing device 33.

Figure 2:
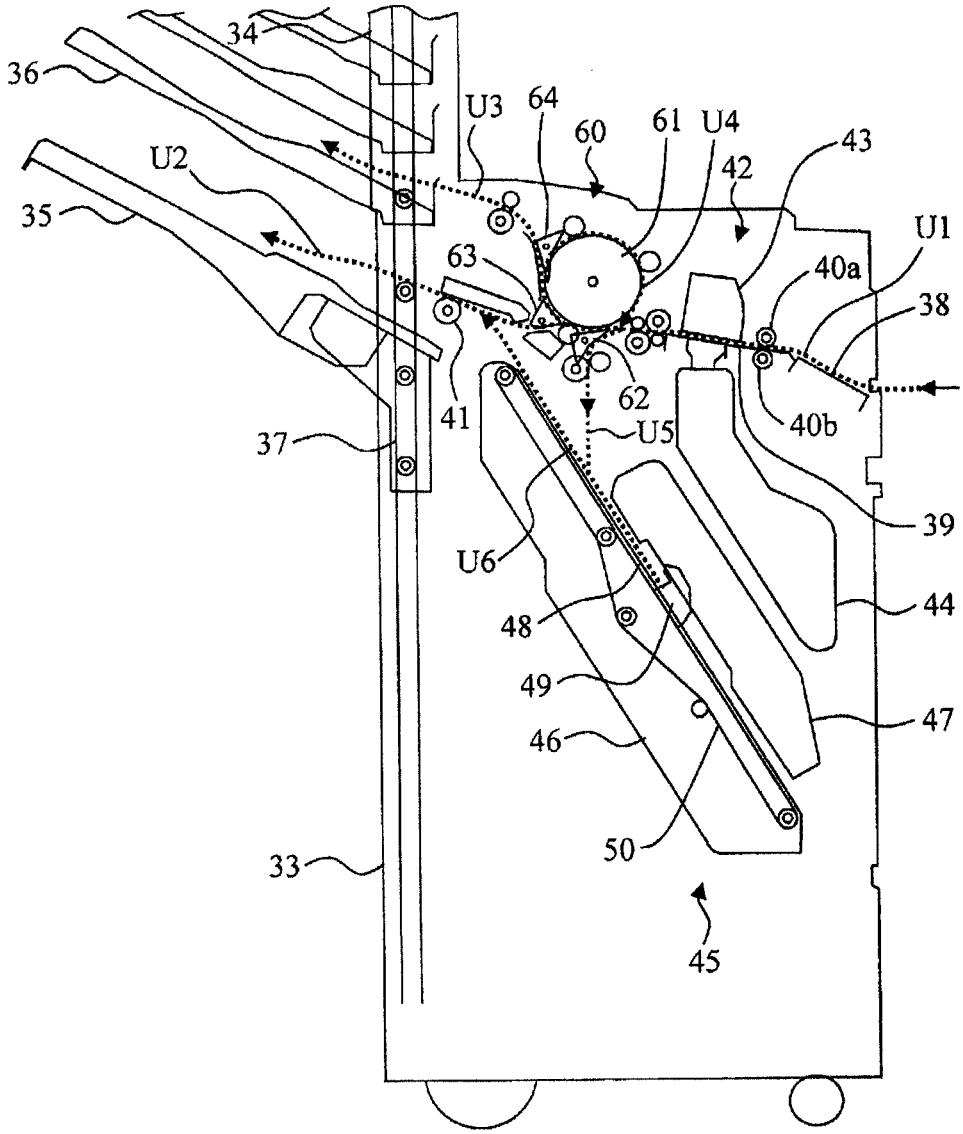
FIG. 2 is a schematic view showing an example of an internal configuration of the post-processing device according to an embodiment of the present disclosure.

FIG. 2 is a diagram showing an internal configuration of the post-processing device according to an embodiment of the present disclosure. In FIG. 2, the multi-job trays 36 are partially omitted. The post-processing device 33 according to the present embodiment 33 is composed mainly of a punching unit 42, a staple unit 45, and a paper branching conveying unit 60. The punching unit 42 forms a hole on the printed paper fed from the image forming apparatus. The staple unit 45 staples for binding a stack of a plurality of sheets of paper. The paper branching conveying unit 60 performs temporary evacuation of the paper being conveyed, and switching of paper conveyance routes.

The punching unit 42 is composed of a punching portion 43 and a chad storage portion 44. In a case in which punching is desired, the paper being conveyed temporarily stops at a predetermined position between the punching portion 43 and the chad storage portion 44. Although not illustrated in detail, the punching portion 43 includes, for example, a plurality of tubular blades for punching. The punching portion 43 performs punching in such a way that the punching portion 43 and the chad storage portion 44 move back and forth vertically with respect to a paper surface, while supporting the paper on the chad storage portion 44 side. Chads generated by punching are stored in the chad storage portion 44.

The staple unit 45 includes a stapling portion 46 and a cover portion 47 arranged to face the stapling portion 46, and is disposed to be inclined as a whole. An upper face of the stapling portion 46 is substantially flat and functions as an intermediate tray 48 that receives the paper fed from above for stapling. In the stapling portion 46, a plurality of staplers is provided at a plurality of positions. This allows stapling binding processes according to purposes, for example by stapling at a corner of the paper placed on the intermediate tray 48, by stapling at two positions on one side of the paper, and the like.

The stapling portion 46 includes a paper supporting body 49 that projects from a surface of the intermediate tray 48 that is inclined. The paper supporting body 49 is fixed to an endless belt 50 and can move up and down freely along the surface of the intermediate tray 48 by rotation of a plurality of pulleys attached to the endless belt 50. The intermediate tray 48 therefore has an elongated opening along a moving route of the paper supporting body 49. The paper supporting body 49 supports a bottom end of the paper placed on the inclined surface of the intermediate tray 48, and performs: positioning of the paper for stapling; conveyance of the paper to the main tray 35 after stapling; and the like.

The paper branching conveying unit 60 is, as described later in detail, composed mainly of an evacuation drum 61 and three branching guides 62, 63 and 64. The three branching guides 62, 63 and 64 are provided in the vicinity of the evacuation drum 61. A main function of the evacuation drum 61 is, during conveyance of the paper inside the post-processing device 33, to wind therearound and temporarily hold the paper fed from the image forming unit 22 of the multifunction peripheral 100 for stapling by the stapling unit 45. The evacuation drum 61 winds therearound the paper by rotating along with a plurality of rollers in contact with a periphery thereof. The branching guides 62, 63 and 64 are rotationally movable only within a range of a small angle. As the branching guides 62, 63 and 64 rotationally move and form predetermined arrangements with respect to the evacuation drum 61, a plurality of paper feeding paths can be formed and paper feeding directions can be switched.

In the post-processing device 33, a plurality of feeding paths are provided by switching arrangements of the branching guides 62 to 64, that are shown by broken-line arrows in FIG. 2. A feeding path U1 is a path for introducing the paper that extends from an introduction opening of the post-processing device 33 to the vicinity of a lower-right branching guide 62 of the evacuation drum 61 in FIG. 2. In the feeding path U1, the printed paper ejected from the image forming apparatus (not illustrated) is introduced into the post-processing device 33 from a right side of FIG. 2, fed along a conveyance guide 38, and then pinched between a pair of conveyance rollers 40*a* and 40*b*. After being released from the conveyance rollers 40*a* and 40*b*, the paper is fed along a conveyance guide 39 and can pass between the punching portion 43 and the chad storage portion 44 of the punching unit 42. In the middle of the feeding path U1, the plate-like conveyance guides 38, 39 and the like are provided for securing paper feeding paths.

A conveyance path U2 is a path for ejecting the paper. In FIG. 2, the paper is conveyed from the vicinity of a lower left branching guide 63 of the evacuation drum 61 toward the main tray 35, via the conveyance roller 41. In the middle of the conveyance path U2, the conveyance roller 41 and the like are provided for ensuring conveyance toward the main tray 35. A conveyance path U3 is a path for conveying the paper from the vicinity of the lower left branching guide 63 of the evacuation drum 61 to the multi-job trays 36, via a part of an outer periphery of the evacuation drum 61, in FIG. 2. A Plurality of multi-job trays 36 are provided. Each of the plurality of multi-job trays 36 can move up and down respectively, integrally with the main tray 35 along a rail 37 inside the supporting pole 34. As a result, a specified multi-job tray 36 among the plurality of multi-job trays 36 can receive the paper thus conveyed in the conveyance path U3.

A conveyance path U4 is provided on substantially whole periphery of the evacuation drum 61, and the paper passes through the conveyance path U4 for being wound by the evacuation drum 61. A conveyance path U5 is a path extending from the vicinity of the lower right branching guide 62 of the evacuation drum 61 to the intermediate tray 48 of the stapling unit 45, in FIG. 2. A conveyance path U6 is a path that is parallel to the surface of the intermediate tray 48 and used for conveying the paper on the intermediate tray 48 and ejecting the paper toward the main tray 35. Switching of the branching guides 62, 63 and 64 determines a conveyance path to be used among the above-described paths.

Figure 3:
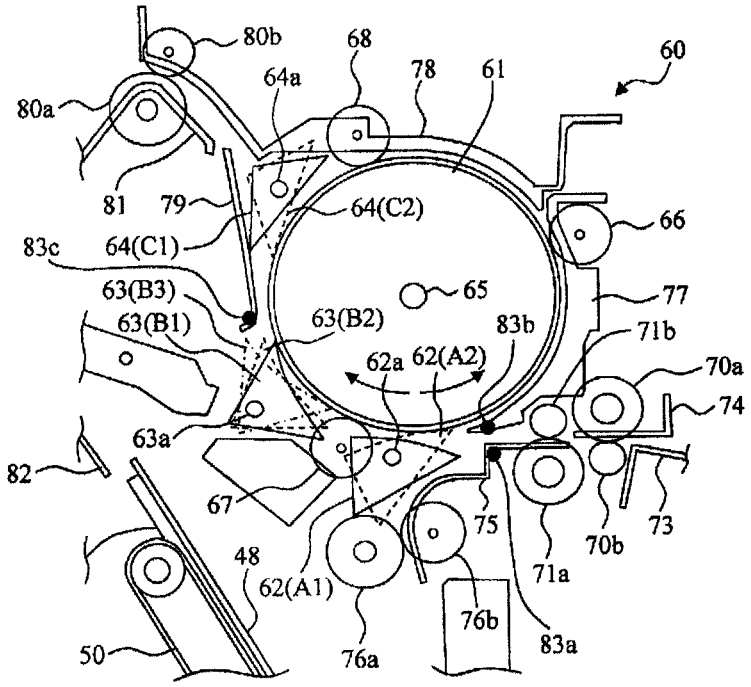
FIG. 3 is a detailed structural view of a paper feeding branching portion in the post-processing device according to the embodiment of the present disclosure.

A detailed structure of the paper branching conveying unit 60 is described hereinafter. FIG. 3 is a diagram illustrating a detailed structure of the paper branching conveying unit 60. The evacuation drum 61 has a cylindrical shape with a peripheral surface extending in a direction vertical to the sheet, and is arranged to be rotatable about a main shaft 65 in two opposite directions shown by arrows in FIG. 3, by a motor (not illustrated). In this case, the direction vertical to the sheet corresponds to a direction of the conveyance paths (especially the conveyance paths U1 to U5) shown in FIG. 2.

A width of the periphery of the evacuation drum 61, in other words the width orthogonal to a paper conveyance direction, is set to be slightly greater than a maximum paper width accepted by the post-processing device 33. The evacuation drum 61 can wind around a peripheral surface thereof all kinds of paper that can be conveyed.

On an upstream side of the evacuation drum 61 in the conveyance path U1, in a conveying direction, a plate-like conveyance guide 73 is provided below the conveyance path U1 and a plate-like conveyance guide 74 is provided above the conveyance path U1. A lower conveyance guide 73 and an upper conveyance guide 74 controls the paper fed from the punching unit 42 (see FIG. 2) and guides the paper to be pinched between the pair of conveyance rollers 70*a*, 70*b* provided vertically. The paper released from the conveyance rollers 70*a*, 70*b* is then pinched between another pair of conveyance rollers 71*a*, 71*b* provided vertically. The paper is then fed to a horizontal part of the plate-like conveyance guide 75 provided more on the upstream side in the conveyance path U1 than the branching guide 62 immediately below the evacuation drum 61 (lower right side of the evacuation drum 61 in FIG. 3). As described above, the conveyance guides 73, 74, the horizontal part of the conveyance guide 75, the conveyance rollers 70*a*, 70*b*, and the conveyance rollers 71*a*, 71*b* constitute a part of the conveyance path U1.

The evacuation drum 61 winds, around a peripheral surface thereof, the paper conveyed in the conveyance path U1 as described above by rotating in the conveyance direction of the paper, in other words in a clockwise direction in FIG. 3. Hereinafter, the direction of winding the paper is referred to as "a winding direction", and an opposite direction is referred to as "a counter-winding direction".

On a downstream side of the branching guide 62 in the winding direction of the evacuation drum 61, a sub feeding roller 67 is provided. The paper is fed after being pinched between peripheral surfaces of the sub feeding roller 67 and the evacuation drum 61. Further on the downstream side of the sub feeding roller 67 in the winding direction of the evacuation drum 61, a branching guide 63 for switching the conveyance direction of the paper to a direction of the conveyance path U2, or to directions of conveyance paths U3 and U4, is provided.

On the downstream side of the branching guide 63 in the winding direction of the evacuation drum 61 (on an upper left side of the evacuation drum 61 in FIG. 3), a branching guide 64 for switching the conveyance direction of the paper between the conveyance path U3 and the conveyance path U4. In addition, between the branching guide 63 and the branching guide 64, a plate-like conveyance guide 79, which constitutes a part of the conveyance path U3 with the branching guide 64, is provided.

On the downstream side of the branching guide 64 in the winding direction of the evacuation drum 61 (on an upper side to a right side of the evacuation drum 61 in FIG. 3), arcuate-shaped conveyance guides 78 and 77 are provided. The conveyance guides 78 and 77 form a narrow gap with the peripheral surface of the evacuation drum 61 through which the paper can pass. In addition, in the vicinity of an upstream end in the winding direction of each of the conveyance guides 78 and 77, evacuation rollers 68 and 66 that pinch and convey the paper with the evacuation drum 61 are respectively provided. With the evacuation rollers 68 and 66, the paper can infallibly be caught and pressed against the evacuation drum 61, allowing stable winding of the paper.

The horizontal part of the conveyance guide 75 is bent at a right angle on the downstream side in the conveyance path U1 and curved along the conveyance path U5. The paper can thus be guided to the pair of conveyance rollers 76*a* and 76*b*. The conveyance rollers 76*a* and 76*b* are disposed below the branching guide 62. The conveyance rollers 76*a* and 76*b* guide the paper to the stapling unit 45. On the other hand, the conveyance guide 78 has a part extending from the vicinity of the evacuation roller 68, in the paper conveyance direction (upper left direction from the evacuation drum 61 in FIG. 3) in the conveyance path U3. This part is adjacent to a paper conveyance terminal part of the conveyance guide 79. This part and the conveyance guide 81 extending in the paper conveyance direction in the conveyance path U3 guide the paper to the conveyance rollers 80*a*, 80*b*. This part constitutes a part of the conveyance path U3.

In addition, on the downstream side of the evacuation drum 61 in the conveyance path U2 for ejecting the paper, a plate-like conveyance guide 82 is provided. The plate-like conveyance guide 82 is adjacent to the conveyance path U6 on the intermediate tray 48 in the paper conveyance direction, and guides the paper in an ejection direction.

The branching guide 62 is in a substantially triangle shape in a side view of FIG. 3, in which a side (a convex curved side in the drawing; hereinafter referred to as "base") faces the evacuation drum 61. The branching guide 62 is rotatably supported by a shaft 62*a* that is parallel to the main shaft 65, at a position opposite to the evacuation drum 61 across the base. The branching guide 62 rotates to be switched between: a posture A1 (solid line in FIG. 3; reference numeral 62 (A1)) and a posture A2 (dotted line in FIG. 3; reference numeral 62 (A2)).

The conveyance paths U2 to U4 are formed in a state in which a gap is formed between the peripheral surface of the evacuation drum 61 and the branching guide 62 (posture A1). On the other hand, the conveyance path U5 along the oblique side of the branching guide 62 is formed in a state in which an apex of the branching guide 62 on a side to the conveyance path U1 is in contact with the peripheral surface of the evacuation drum 61 (posture A2).

The branching guide 63 is also in a substantially triangle shape in a side view of FIG. 3, in which a side (a concave curved side in the drawing; hereinafter referred to as "base") faces the evacuation drum 61. The branching guide 63 is rotatably supported by a shaft 63*a* that is parallel to the main shaft 65, at a position opposite to the evacuation drum 61 across the base. The branching guide 63 rotates to be switched between: a posture B1 (solid line in FIG. 3; reference numeral 63 (B1)), a posture B2 (dotted line in FIG. 3; reference numeral 63 (B2)), and a posture B3 (dashed-dotted line in FIG. 3; reference numeral 63 (B3)).

Reversing conveyance (described later) can be performed in a state in which an apex of the branching guide 63 on the downstream side in the winding direction of the evacuation drum 61 is in contact with the peripheral surface of the evacuation drum 61 (posture B1). The conveyance paths U3 and U4 are formed in a state in which a gap is formed between the base of the branching guide 63 and the peripheral surface of the evacuation drum 61 (posture B2). In addition, the conveyance path U2 is formed in a state in which an apex of the branching guide 63 on an upstream side in the winding direction of the evacuation drum 61 is in contact with the peripheral surface of the evacuation drum 61 (posture B3).

The branching guide 64 is in a triangle shape in a side view of FIG. 3, in which a side (hereinafter referred to as "base") faces the evacuation drum 61. The branching guide 64 is rotatably supported by a shaft 64*a* that is parallel to the main shaft 65, at a position opposite to the evacuation drum 61 across the base. The branching guide 64 rotates to be switched between: a posture C1 (solid line in FIG. 3; reference numeral 64 (C1)) and a posture C2 (dotted line in FIG. 3; reference numeral 64 (C2)).

The conveyance path U4 is formed in a state in which a gap is formed between the base of the branching guide 64 and the peripheral surface of the evacuation drum 61 (posture C1). In addition, the conveyance path U3 is formed between the branching guide 64 and the conveyance guide 79, in a state in which an apex of the branching guide 64 on the upstream side in the winding direction of the evacuation drum 61 is in contact with the peripheral surface of the evacuation drum 61 (posture C2).

Each of the branching guides 62, 63 and 64 has a plurality of guide plates arranged to be orthogonal to the main shaft 65 of the evacuation drum 61 and arrayed in a direction of the main shaft 65. The plurality of guide plates is connected to the rotational shaft (62*a*, 63*a* or 64*a*). Grooves (approximately 0.5 mm to 1.0 mm) corresponding to the guide plates are provided on the peripheral surface of the evacuation drum 61 along a peripheral direction. As the apex of the branching guide on the upstream side or the downstream side in the winding direction is engaged with the groove as necessary (being "in contact with the peripheral surface of the evacuation drum 61" in the above description), the paper does not advance along the peripheral surface of the evacuation drum 61.

Rotational movement of the branching guides 62, 63 and 64 is realized by a solenoid actuator using an electromagnet (not illustrated).

In the vicinity of the peripheral surface of the evacuation drum 61, three paper detection sensors 83*a*, 83*b* and 83*c* for detecting an end of the paper are provided. These sensors are for example reflective sensors composed of a light emitting element and a light receiving element. The sensor 83*a* is provided on the horizontal part of the conveyance guide 75, on a side to the stapling unit 45 (see FIG. 2). The sensor 83*a* detects an end of the paper being conveyed in the conveyance path U1 and defines a temporary stop position of the paper before conveying to the conveyance path U5. The sensor 83*b* is provided on the conveyance guide 77, in a terminal part thereof on the downstream side in the winding direction of the evacuation drum 61. The sensor 83*b* defines a paper end position upon winding of the paper around the evacuation drum 61, and a winding conveyance stop position of the paper end. The sensor 83*c* is provided on the conveyance guide 79. The sensor 83*c* is positioned at an end portion of the evacuation drum 61 on the upstream side in the winding direction and detects a position of a rear end of the paper upon winding of the paper around the evacuation drum 61.

The sensor 83*c* detects a rear end of the paper when a fore end of the paper is positioned at the sensor 83*b*. The position of the sensor 83*c* therefore depends on a paper size. In the present embodiment, the paper of only one size is wound and a rear end thereof is detected. In order to detect a plurality of paper sizes (smaller than that of the present embodiment), for example, a rear end detection sensor for the paper of a relevant size should be provided at a position more on a downstream side than the sensor 83*b* in the winding direction of the evacuation drum 61, in the vicinity of the peripheral surface of the evacuation drum 61.

Figure 4:
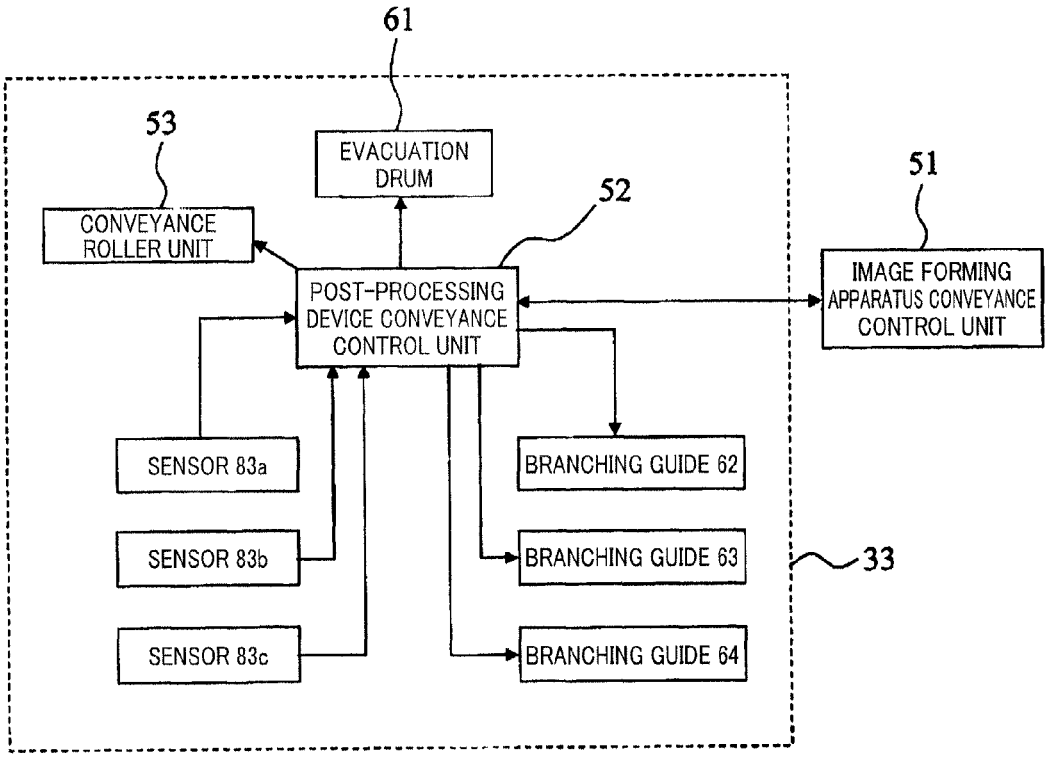
FIG. 4 is a schematic functional block diagram of the post-processing device according to the embodiment of the present disclosure.

FIG. 4 is a schematic block diagram of the post-processing device 33 (FIG. 1) according to the embodiment of the present disclosure, from a viewpoint of a paper conveyance control function. The post-processing device 33 is composed of: a conveyance control unit 52 in the center; the evacuation drum 61; the branching guides 62, 63 and 64; the sensors 83*a*, 83*b* and 83*c*, and a conveyance roller unit 53 including at least conveyance roller pairs (70*a*, 70*b*), (71*a*, 71*b*) and (76*a*, 76*b*).

In the image forming apparatus 10 (FIG. 1), the conveyance control unit 51 that controls paper conveyance in the image forming apparatus 10 is provided. The conveyance control unit 51 obtains paper conveyance information in the post-processing device 33 from the conveyance control unit 52, and conveys the paper to the post-processing device 33 at an appropriate timing matched to a paper conveyance state. The conveyance control unit 51 submits an instruction to the conveyance control unit 52 to operate in a plurality of conveyance modes (described later).

The conveyance control unit 52 includes programs to perform the plurality of conveyance modes. The conveyance control unit 52 selects a program to be executed based on the instruction from the conveyance control unit 51. By the programs and information from the sensors 83*a* to 83*c*, the conveyance control unit 52 controls drive of the evacuation drum 61, the branching guides 62 to 64, and the conveyance roller unit 53, to thereby convey the paper in a predetermined mode.

The post-processing device 33 according to the present embodiment realizes various paper conveyance modes including a reversing conveyance, by means of the paper branching conveyance unit 60 configured as in FIG. 3 and the conveyance control unit 52 configured as in FIG. 4. Various paper conveyance operations performed by the paper branching conveyance unit 60 are described hereinafter with reference to FIGS. 4 to 11.

Figure 5:
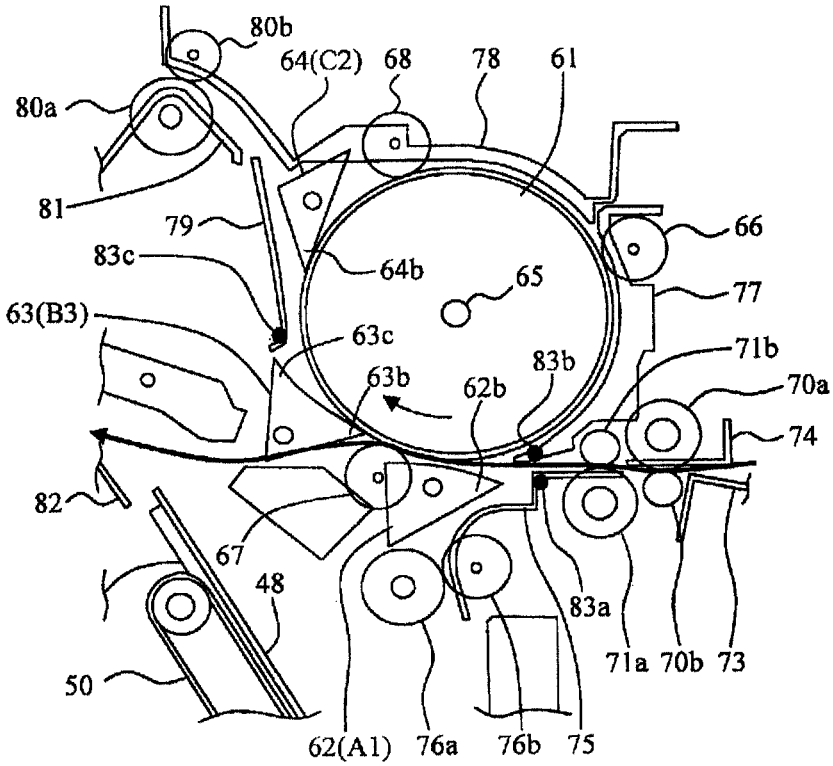
FIG. 5 is a diagram illustrating an operation of the paper feeding branching portion in normal feeding of the paper to a tray.

FIG. 5 is a diagram explaining an operation of the paper branching conveyance unit 60 in a case in which the paper branching conveyance unit 60 operates in a first conveyance mode for conveying the paper from the conveyance path U1 to, for example, the main tray 35 via the conveyance path U2 (see FIG. 2). In this case, a paper conveyance route is in a linear shape as shown by a thick arrow in FIG. 5, that is the most typical conveyance mode of the paper processed by the image forming unit 22 (see FIG. 1) of the multifunction peripheral 10.

In response to an instruction of execution of the first conveyance mode from the conveyance control unit 51, the conveyance control unit 52 of the post-processing device 33 starts control of the paper branching conveyance unit 60. The paper branching conveyance unit 60 is operated as follows. First, the conveyance control unit 52 activates solenoid actuators as the first driving unit and the second driving unit; the branching guide 62 is in the posture A1; and the branching guide 63 is in the posture B3. The first driving unit and the second driving unit can rotationally move the branching guides 62, 63 and 64. On the other hand, since the branching guide 64 does not serve to conveyance, the branching guide 64 can be in any of the postures C1 and C2. In FIG. 3, the branching guide 64 is in the posture C2. As the branching guide 62 is in the posture A1, a narrow gap through which the paper can pass is formed between the peripheral surface of the evacuation drum 61 and the base of the triangle shape of the branching guide 62.

As the branching guide 63 is in the posture B3, an apex 63*b* of the triangle shape of the branching guide 63, which is on an upstream side in the winding direction of the evacuation drum 61, is in contact with the peripheral surface of the evacuation drum 61. A paper conveyance path along a bottom side of the branching guide 63 that guides the paper toward the main tray 35 is thus formed.

After moving the branching guides 62 and 63 to the above-described postures, the conveyance control unit 52 controls the first driving unit (not illustrated) that rotates the evacuation drum 61 to rotate the evacuation drum 61, the conveyance rollers 70*a*, 70*b*, and 71*a*, 71*b*. The first driving unit can rotate the evacuation drum 61. The paper is thus guided to the conveyance guides 73, 74, 75, then introduced to a downstream direction of the conveyance path U1 (right to left direction in FIG. 5), and a fore end of the paper reaches the branching guide 62. The paper then passes through the conveyance path between the evacuation drum 61 and the branching guide 62, and reaches a fore end of the branching guide 63 from between the evacuation drum 61 and the sub feeding roller 67 according to rotation of the evacuation drum 61 in the winding direction (hereinafter referred to as rotation in winding direction). Here, since the fore end of the branching guide 63 is in contact with the evacuation drum 61, the paper advances toward the main tray 35 along the bottom side of the branching guide 63.

Figure 6:
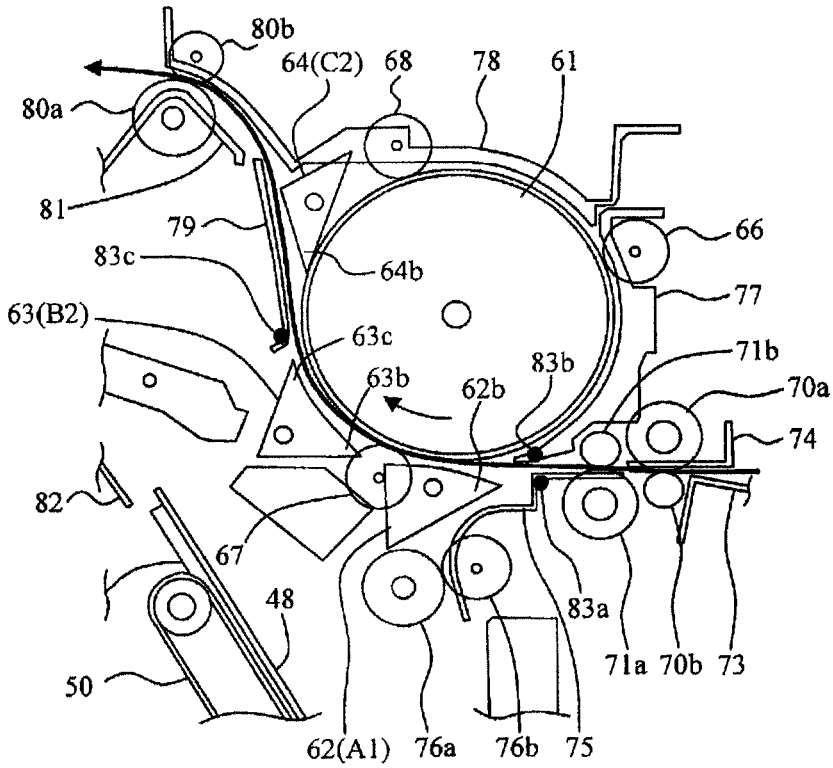
FIG. 6 is a diagram illustrating an operation of the paper feeding branching portion in sorted feeding of the paper to the tray.

FIG. 6 is a diagram explaining an operation of the paper branching conveyance unit 60 in a case in which the paper branching conveyance unit 60 operates in a second conveyance mode for conveying the paper from the conveyance path U1 to, for example, the multi-job tray 36 via the conveyance path U3 (see FIG. 2). A conveyance path of the paper is shown by a thick arrow in FIG. 5. In response to an instruction of execution of the second conveyance mode from the conveyance control unit 51, the conveyance control unit 52 starts control of the paper branching conveyance unit 60. The paper branching conveyance unit 60 is operated as follows. First, the conveyance control unit 52 activates solenoid actuators before conveying the paper; the branching guide 62 is in the posture A1; the branching guide 63 is in the posture B2; and the branching guide 64 is in the posture C2.

Since the branching guide 62 is in the posture A1, a paper conveyance path through which the paper passes is formed between the branching guide 62 and the peripheral surface of the evacuation drum 61, similarly to the first conveyance mode (FIG. 4). Since the branching guide 63 is in the posture B2, a gap is formed between the peripheral surface of the evacuation drum 61 and the base of the triangle of the branching guide 63, thereby forming a paper conveyance path composed of a narrow gap, through which the paper passes, between the branching guide 63 and the peripheral surface of the evacuation drum 61.

On the other hand, since the branching guide 64 is in the posture C2, an apex 64*b* of the triangle of the branching guide 64, on the upstream side in the winding direction of the evacuation drum 61, is in contact with the peripheral surface of the evacuation drum 61. The conveyance path U3 is thus formed between the conveyance guide 79 and the branching guide 64. The branching guide 64 thus constitutes a part of the conveyance path U3 that guides the paper toward the multi-job tray 36. The part of the conveyance path U3 is composed of a narrow gap between the peripheral surface of the evacuation drum 61 and the conveyance guide 79 and a narrow gap between the branching guide 64 and the conveyance guide 79, as shown in FIG. 6.

After that the branching guides 62, 63 and 64 are in the abovementioned postures, the conveyance control unit 52 rotates the evacuation drum 61, the conveyance rollers 70*a* and 70*b*, as well as 71*a* and 71*b*. The paper is thus introduced to a downstream direction of the conveyance path U1 along the conveyance guides 73, 74, 75, (right to left direction in FIG. 6), and a fore end of the paper reaches the branching guide 62. The paper then passes through the conveyance path between the evacuation drum 61 and the branching guide 62, and is fed toward between the peripheral surface of the evacuation drum 61 and the branching guide 63, by the evacuation drum 61 rotating in the winding direction and the sub feeding roller 67. The paper then reaches the apex of the branching guide 64, the apex of the branching guide 64 being in contact with the evacuation drum 61. The paper is thus conveyed toward the multi-job tray 36 along the conveyance path U3 consisting of: a gap between a back surface of the branching guide 64 and the conveyance guide 79; a gap between a part of the conveyance guide 78 extending from the evacuation roller 68 to the downstream direction of the conveyance path U3 (left direction in FIG. 6) and the conveyance guide 81; and a gap between the conveyance rollers 80*a* and 80*b*.

FIGS. 7A, 7B and FIGS. 8A, 8B are diagrams illustrating operations of the paper branching conveyance unit 60 that is driven in the third conveyance mode for conveying a plurality of sheets of paper to the stapling unit 45 (see FIG. 2) for stapling processing. In this conveyance mode, the paper is conveyed to the stapling unit 45 via, not only the conveyance paths U1 and U5, but also the conveyance path U4 in which the paper is conveyed in a state of being wound around the peripheral surface of the evacuation drum 61.

Driving a staple into a stack of paper composed of a plurality of sheets for binding generally takes longer than an interval between sequential feeding of the paper to the post-processing device 33 upon printing by the image forming unit 22 of the multifunction peripheral 10. Therefore, the stapling processing cannot keep up with the feeding of the paper. The evacuation drum 61 is originally provided for addressing this problem and temporarily evacuates the paper to be subsequently stapled, which is fed from the image forming unit 22, until the previous stapling processing is completed.

An operation of the paper branching conveyance unit 60 in the third conveyance mode is described hereinafter. In response to an instruction of execution of the third conveyance mode from the conveyance control unit 51, the conveyance control unit 52 starts control of the paper branching conveyance unit 60. The paper branching conveyance unit 60 is operated as follows. First, as shown in FIG. 7A, the conveyance control unit 52 controls the branching guide 62 to be in the posture A1 and the branching guide 63 to be in the posture B2. Since the branching guide 62 is in the posture A1, a paper conveyance path through which the paper passes is formed between the branching guide 62 and the peripheral surface of the evacuation drum 61, similarly to the second conveyance mode (FIG. 6). In addition, since the branching guide 63 is in the posture B2, a paper conveyance path through which the paper passes is formed between the branching guide 63 and the peripheral surface of the evacuation drum 61.

On the other hand, as the branching guide 64 is in the posture C1, a gap is formed between the peripheral surface of the evacuation drum 61 and the base of the triangle shape of the branching guide 64, thereby forming the conveyance path U4. Here, the apex 64*b* of the branching guide 64 is preferably in contact with the conveyance guide 79, as shown in FIG. 7A.

As shown in FIG. 7A, the conveyance control unit 52 then rotates the evacuation drum 61, the conveyance rollers 70*a* and 70*b*, as well as 71*a* and 71*b*. A first sheet of paper P1 fed from the image forming unit 22 (thick solid line) is guided by the conveyance guides 73, 74, 75 and the like and conveyed to the downstream side of the conveyance path U1. Thereafter, a fore end of the first sheet of paper P1 is caught by the peripheral surface of the evacuation drum 61 by means of the evacuation drum 61 rotating in the winding direction and the sub feeding roller 67, starts to be wound by the evacuation drum 61, and then is introduced into the conveyance path U4.

Figure 7B:
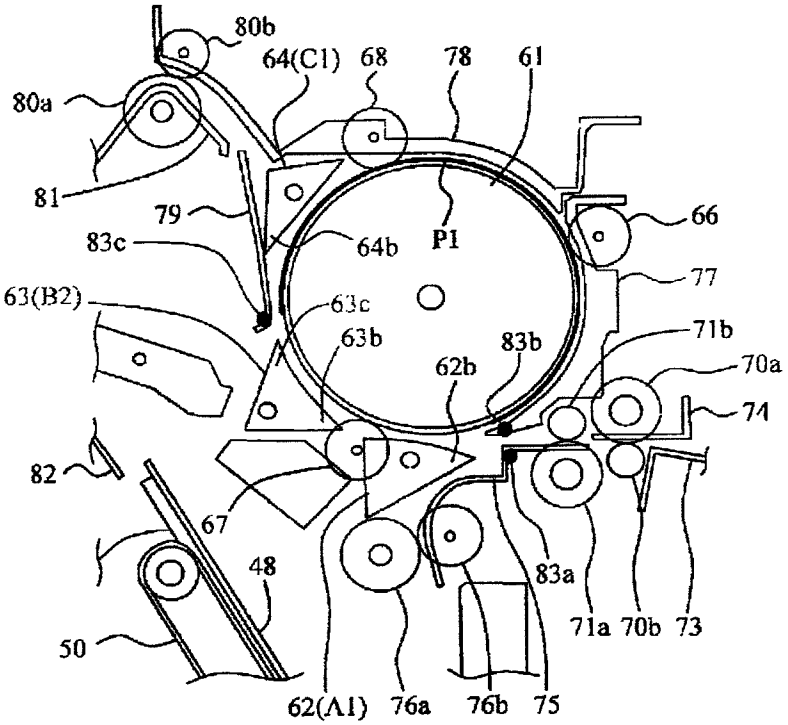
FIG. 7B is a diagram illustrating an operation of the paper feeding branching portion in feeding of the paper to a stapling unit.
Figure 7A:
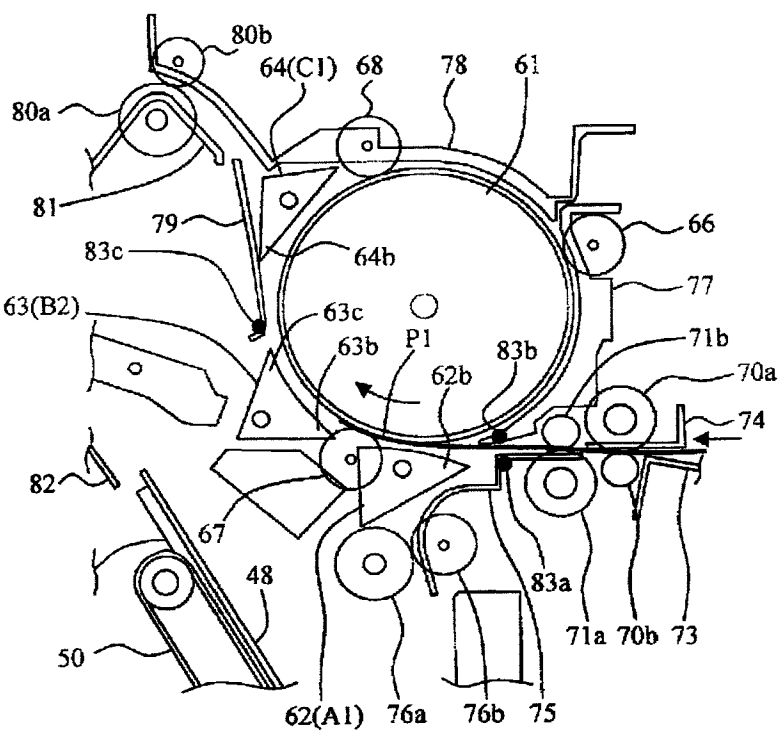
FIG. 7A is a diagram illustrating an operation of the paper feeding branching portion in feeding of the paper to a stapling unit.

And then, as shown in FIG. 7B, the paper P1 advances further in the conveyance path U4 and the entire sheet of the paper P1 is wound by the evacuation drum 61 rotating in the winding direction. When the fore end of the paper P1 reaches the sensor 83*b*, the sensor 83*b* detects the fore end of the paper P1 and submits a detection signal to the conveyance control unit 52. The conveyance control unit 52 stops rotation of the evacuation drum 61 based on the detection signal. After winding of the paper P1, a second sheet of paper P2 (shown in FIGS. 8A and 8B) is conveyed in the conveyance path U4 via the conveyance path U1 (not shown in FIG. 7B). When a fore end of the second sheet of paper P2 reaches the sensor 83*b*, similarly, the sensor 83*b* detects the fore end of the paper P2 and the conveyance control unit 52 stops rotation of the evacuation drum 61 based on the detection signal from the sensor 83*b*.

Figure 8B:
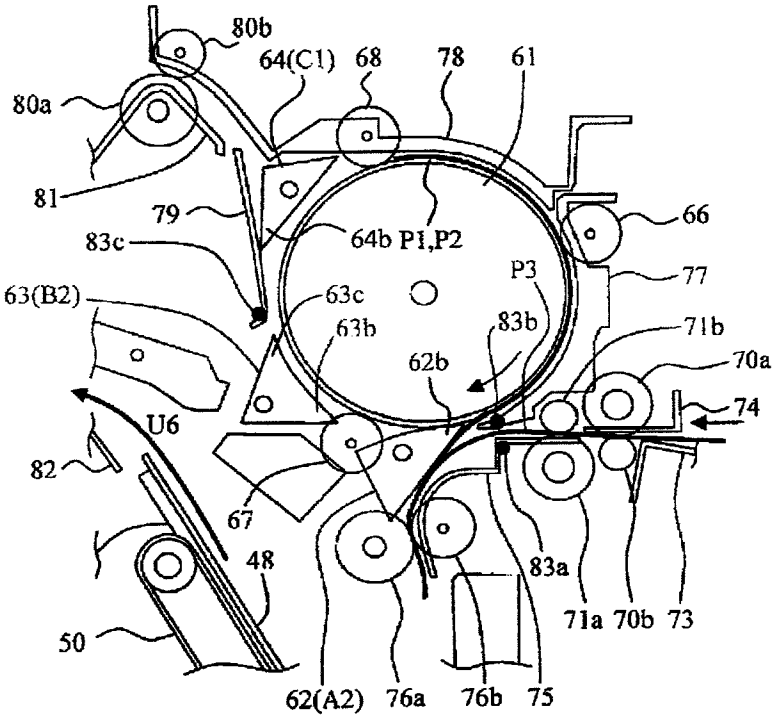
FIG. 8B is a diagram illustrating an operation of the paper feeding branching portion in feeding of the paper to the stapling unit.
Figure 8A:
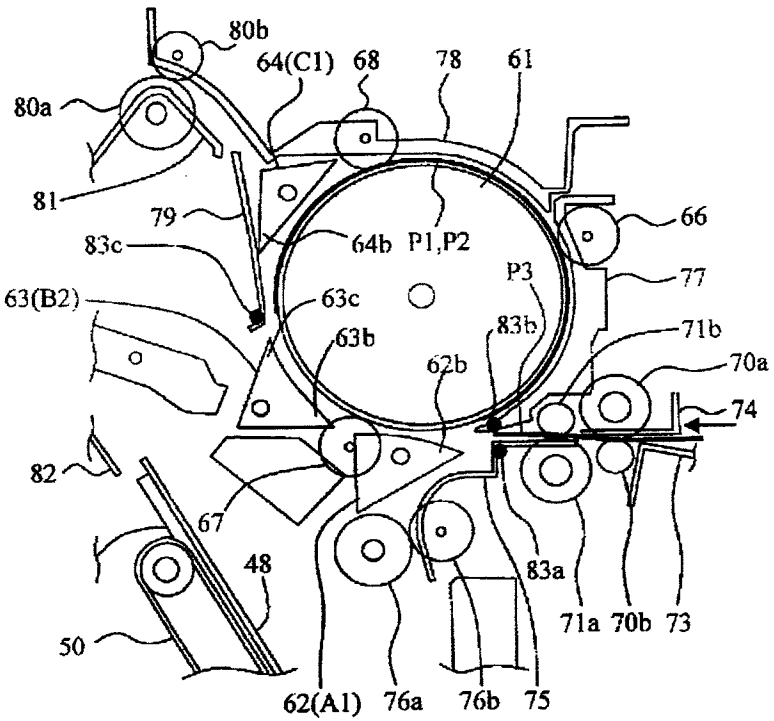
FIG. 8A is a diagram illustrating an operation of the paper feeding branching portion in feeding of the paper to the stapling unit.

Next, as shown in FIG. 8A, after that the sheets of paper P1 and P2 are wound by the evacuation drum 61, the conveyance control unit 52 rotates the conveyance rollers 70*a*, 70*b* and 71*a*, 71*b* to convey a third sheet of paper P3 (thick solid line) to the conveyance path U1. And then, a fore end of the paper P3 is detected by the sensor 83*a*. In response to a detection signal, the conveyance control unit 52 stops rotation of the conveyance rollers 70*a*, 70*b* and the conveyance rollers 71*a*, 71*b*, to stop conveyance of the paper P3. The paper P3 temporarily stops with the fore end thereof positioned at the sensor 83*a*.

Next, as shown in FIG. 8B, the conveyance control unit 52 maintains the branching guides 63 and 64 in the postures B2 and C1 respectively, and switches the posture of the branching guide 62 from A1 to A2. Since the apex 62*b* of the triangle of the branching guide 62, on the upstream side in the winding direction of the evacuation drum 61, is in contact with the peripheral surface of the evacuation drum 61, the conveyance path U5 is formed below the evacuation drum 61.

Thereafter, the conveyance control unit 52 controls the evacuation drum 61 to start rotating in the winding direction, to convey the sheets of paper P1 and P2, which have been temporarily evacuated, in the conveyance path U5 from the evacuation drum 61 toward the stapling unit 45. The conveyance control unit 52 also controls the conveyance rollers 70*a*, 70*b* and 71*a*, 71*b*, as well as the conveyance rollers 76*a*, 76*b* to start rotation, to convey the paper P3 in the conveyance path U5 from the position of the sensor 83*a* toward the stapling unit 45. Here, by a posture switching operation of the branching guide 62, the sheets of paper P1 to P3 pass through the conveyance path formed along the branching guide 62, below the branching guide 62. The sheets of paper P1 to P3 are then supported between the conveyance rollers 76*a* and 76*b*, and conveyed downward by the rotation of the rollers.

While the sheets of paper P1 and P2 are evacuated to the evacuation drum 61 in steps shown in FIGS. 7B to 8A, in other words in a period from immediately before winding of the sheet of paper P1 to immediately before conveyance of the sheets of paper P1 to P3 to the conveyance path U5, the stapling processing on the prior stack of paper is completed. And then the prior stack of paper is ejected to the main tray 35, for example, via the conveyance path U6 on the intermediate tray 48 (see a thick solid arrow in FIG. 7B). As a result, the sheets of paper P1 to P3 can be conveyed onto the intermediate tray 48 on which no prior stack of paper is present.

FIGS. 9A, 9B, 10A, 10B and 11 are diagrams illustrating operations of the paper branching conveyance unit 60, in which the paper branching conveyance unit 60 of the post-processing device according to the present embodiment is driven in the fourth conveyance mode for ejecting a sheet of paper conveyed from the image forming unit 22 to a tray and the like, while reversing the sheet. In the conveyance mode, the paper branching conveyance unit 60 performs a paper winding operation by rotation of the evacuation drum 61 in the winding direction; a counter-winding direction rotation operation; and a paper conveyance path switching operation for the branching guides 62, 63 and 64.

In response to an instruction of execution of the fourth conveyance mode from the conveyance control unit 51, the conveyance control unit 52 starts control of the paper branching conveyance unit 60. The paper branching conveyance unit 60 is operated as follows. First, as shown in FIG. 9A, the conveyance control unit 52 controls the branching guide 62 to be in the posture A1; the branching guide 63 to be in the posture B2; and the branching guide 64 to be in the posture C1. These postures are the same as an initial state (see FIG. 7A) in the third conveyance mode. Therefore, a gap through which the paper can pass is formed: between the branching guide 62 and the peripheral surface of the evacuation drum 61; between the branching guide 63 and the peripheral surface of the evacuation drum 61; and between the branching guide 64 and the peripheral surface of the evacuation drum 61. The conveyance path U4 is thus prepared.

Thereafter, the conveyance control unit 52 then rotates the evacuation drum 61, the conveyance rollers 70*a* and 70*b*, as well as 71*a* and 71*b*. As a result, the paper P (thick solid line) is guided from the image forming unit 22 by the conveyance guides 73, 74 and 75 to the downstream side of the conveyance path U1 (right to left direction in FIG. 9A). Since the paper P is generally conveyed from the image forming unit 22 with a printed face directed downward (face-down), an upper face of the paper P is a reverse face (non-printed face) and a lower face is a top face (printed face) in FIG. 9A. When the fore end of the paper P reaches the sensor 83*a*, the sensor 81*a* detects the fore end of the paper P. Based on a detection signal from the sensor 81*a*, the conveyance control unit 52 controls the evacuation drum 61 to start rotation in the winding direction for conveying the paper P to the conveyance path U4.

Figure 9B:
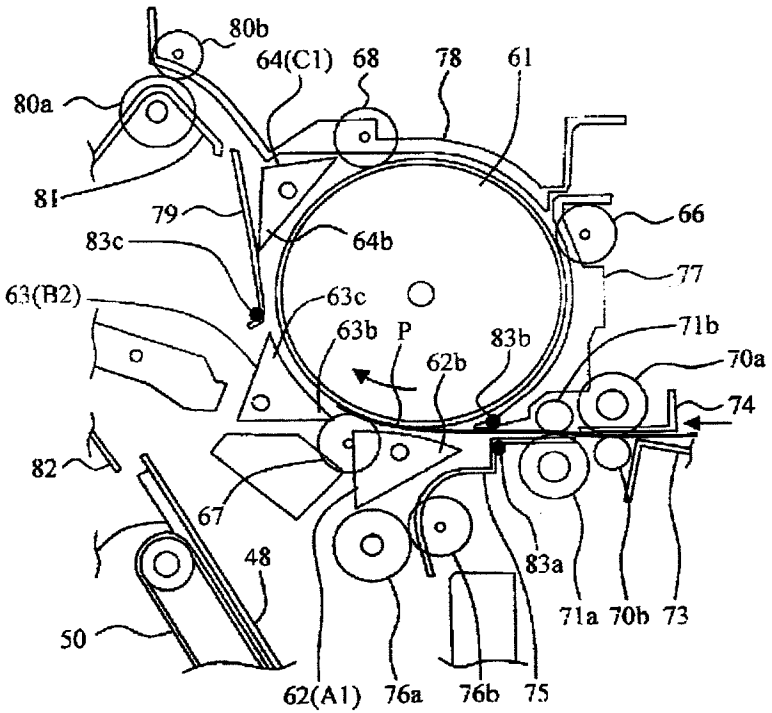
FIG. 9B is a diagram illustrating an operation of the paper feeding branching portion in feeding and output of the paper while reversing the paper.
Figure 9A:
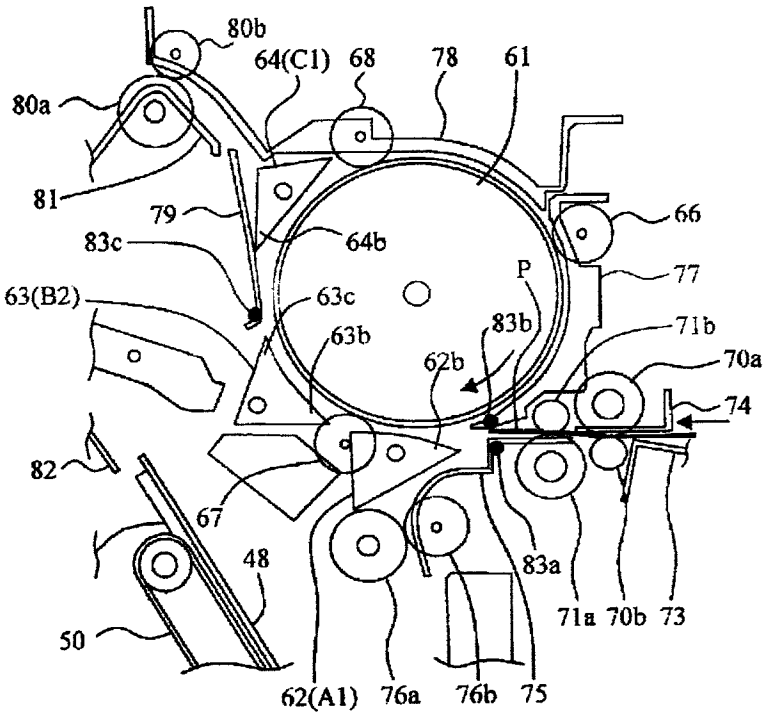
FIG. 9A is a diagram illustrating an operation of the paper feeding branching portion in feeding and output of the paper while reversing the paper.

And then, as shown in FIG. 9B, the paper P is introduced to between the evacuation drum 61 and the sub feeding roller 67, and caught by and pressed against the peripheral surface of the evacuation drum 61 by a pressurizing action of the sub feeding roller 67 onto the peripheral surface of the evacuation drum 61. In this state, the paper P is conveyed along the conveyance path U4 formed by the branching guide 63 in the posture B2, the branching guide 64 in the posture C1, the conveyance guide 78 and 77, and the like, while being wound by the peripheral surface of the conveyance drum 61, as shown in FIG. 10A.

When the fore end of the paper P reaches the sensor 83*a*, the sensor 83*b* detects the fore end of the paper P. The conveyance control unit 52 stops rotation of the evacuation drum 61 based on the detection signal from the sensor 83*b*. The sensor 83*c* is arranged such that a rear end of the paper P is at the position of the sensor 83*c* when the fore end of the paper P is at the position of the sensor 83*b*. The sensor 83*c* thus detects the rear end of the paper P in the state shown in FIG. 10A. The detection signal of the sensor 83*c* is submitted to the conveyance control unit 52. Here, the reverse face of the paper P is a contacting surface with the peripheral surface of the evacuation drum 61 (lower surface) and the top face is directed outward from the peripheral surface.

Figure 10B:
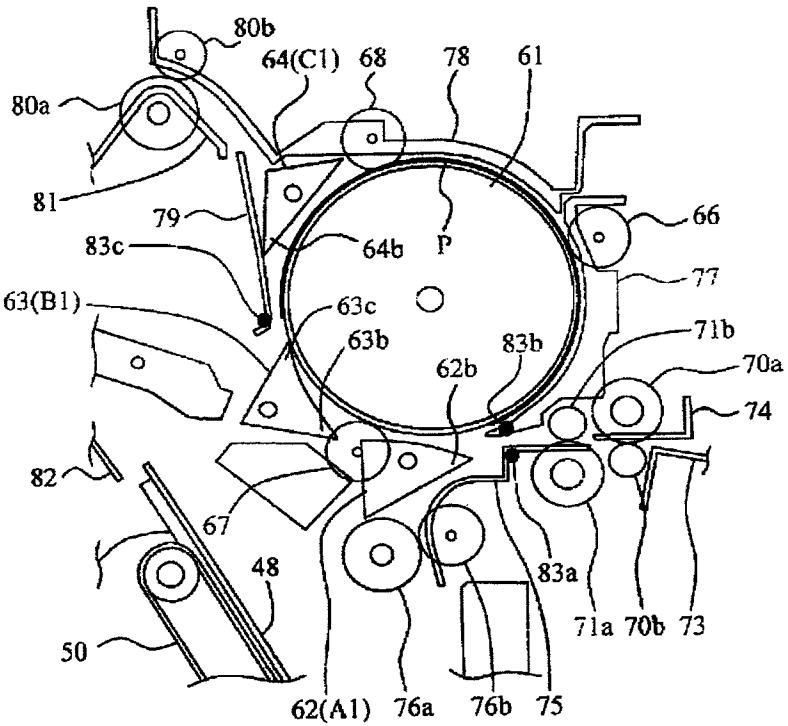
FIG. 10B is a diagram illustrating an operation of the paper feeding branching portion in feeding and output of the paper while reversing the paper.
Figure 10A:
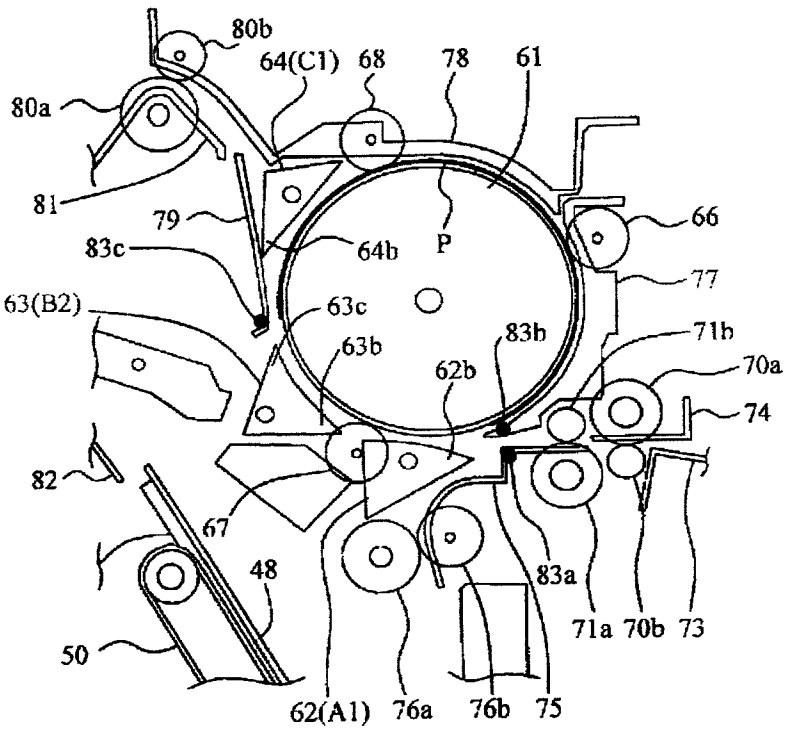
FIG. 10A is a diagram illustrating an operation of the paper feeding branching portion in feeding and output of the paper while reversing the paper.

After stopping rotation of the evacuation drum 61, the conveyance control unit 52 switches the conveyance path of the paper P by controlling the branching guide 62 to be in an arbitrary posture (posture A1 in the drawing), maintaining the branching guide 64 in the posture C1, and switching the posture of the branching guide 63 to B1 as shown in FIG. 10B. Here, the apex 63*c* of the triangle-shaped branching guide 63 positioned on the downstream side in the winding direction of the evacuation drum 61 is in contact with the peripheral surface of the evacuation drum 61. As a result, a conveyance path for moving away from the peripheral surface of the evacuation drum 61 and passing above the branching guide 63 toward the conveyance guide 82 is formed at the apex 63*c* on the downstream side in the winding direction, in contact with the peripheral surface of the evacuation drum 61.

Figure 11:
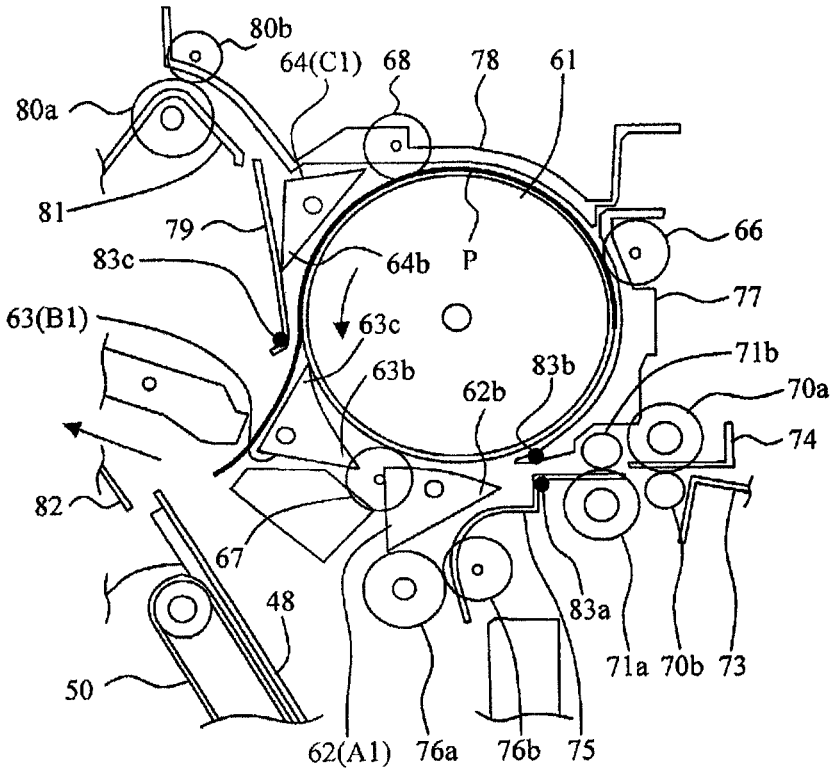
FIG. 11 is a diagram illustrating an operation of the paper feeding branching portion in feeding and output of the paper while reversing the paper.

Next, as shown in FIG. 11, the conveyance control unit 52 controls the evacuation drum 61 to reverse, in other words rotate in a counter-winding direction. As a result, the rear end of the paper P becomes a fore end that reaches the apex 63*c* of the branching guide 63 on the downstream side in the winding direction. Since the apex 63*c* is in contact with the evacuation drum 61, the reverse face of the paper P is gradually spaced apart from the peripheral surface of the evacuation drum 61. The paper P is then conveyed toward the main tray 35 via the conveyance path U2. Here, as shown in FIGS. 10A and 10B, the upper face is the top face (printed face); and the paper P, which has been introduced face-down into the post-processing device 33, is output face-up to the main tray 35 and the like.

As explained in the description of the fourth conveyance mode, the paper branching conveyance unit 60 provided in the post-processing device 33 according to the present embodiment performs an operation of reversing the paper that has been conveyed to the post-processing device 33, with a face on which an image is printed in the image forming unit 22 (top face) directed downward (face-down). The paper branching conveyance unit 60 can then eject the paper with the printed face directed upward (face-up). The evacuation drum 61 and the branching guides 62 to 64 are provided in the post-processing device 33 for realizing the abovementioned first to third conveyance modes for the paper.

In the embodiment of the present disclosure, reversed ejection of the paper by the paper branching conveyance unit 60 is realized by providing: a counter-winding direction rotation function, which is in an opposite direction to a rotation direction in the first to third conveyance mode; and a function to switch the posture of the branching guide 63 to B1. Therefore, according to the present embodiment, a post-processing device provided with a low-cost paper reversing mechanism can be realized, involving substantially no new mechanism for reversed conveyance of the paper and substantially no increase in space occupied in the post-processing device 33.

In summary, the abovementioned post-processing device comprises: a processing unit for a sheet-shaped body; a second branching guide; and a second driving unit.

The second branching guide has a substantially triangle shape of which base faces the drum, and is rotatably supported at a position more on outside than the base in a radial direction of the evacuation drum by a shaft parallel to the main shaft. The apex of the second branching guide on the upstream side in the winding direction can be in contact with, and spaced apart from, the peripheral surface of the evacuation drum. When the apex is separated from the peripheral surface of the evacuation drum, the second branching guide forms a gap from the evacuation drum through which the sheet-shaped body can pass. The second driving unit rotationally moves the second branching guide.

The control means controls the second driving unit. More specifically, the following is realized by controlling the driving unit. In response to an instruction to reverse the sheet-shaped body, the gap is formed between the first branching guide and the evacuation drum and between the second branching guide and the evacuation drum; the evacuation drum rotates in the winding direction; the sheet shaped body passes through the gap; and the sheet shaped body is wound around the evacuation drum. Thereafter, the apex of the first branching guide on the downstream side in the winding direction is in contact with the peripheral surface of the evacuation drum; the evacuation drum rotates in the counter-winding direction; the sheet-shaped body is separated from the evacuation drum; and the sheet-shaped body is ejected with a face, which is opposite to a top face upon winding, directed upward.

In addition, the post-processing device is connected to an image forming apparatus that forms an image on the sheet-shaped body; and the sheet-shaped body is fed to the post-processing device from the image forming apparatus. In this case, a desirable function of the processing unit provided in the post-processing device is a function of stapling a stack of a plurality of sheet-shaped bodies.

As described above, in the post-processing device according to the present disclosure, a cylindrical body rotates in the winding direction; a first face of the sheet-shaped body such as paper faces the peripheral face of the cylindrical body; and the sheet-shaped body is wound therearound from a front end to a rear end. And then, after that the apex of the first branching guide on the downstream side in the winding direction is brought into contact with the peripheral surface of the evacuation drum, the evacuation drum rotates in the counter-winding direction to separate the sheet-shaped body from the evacuation drum. The sheet-shaped body is thus ejected. In such a way, for example, the sheet-shaped body that has been introduced with a first face directed upward can be ejected with a second face, which is opposite to the first face, directed upward.

In a case in which the post-processing device is provided with an evacuation drum as well as a first branching guide or a second branching guide for conveying a sheet-shaped body to a processing unit that performs staple processing and the like, reversing of the sheet-shaped body can be realized using these components. This involves substantially no new mechanism added and substantially no increase in space occupied. As a result, a reversing mechanism for the sheet-shaped body can be installed in the post-processing device at a low cost.

In the above-described embodiment, sheets of paper are conveyed one by one in the fourth conveyance mode. However, the present disclosure is not limited thereto and a plurality (for example, three) of sheets of paper can be reversed and conveyed at once. In this case, the processing of FIGS. 8A, 8B, 9A, and 9B is performed on a first sheet of paper, and the rotation of the evacuation drum 61 is stopped upon detection of a fore end of the paper by the sensor 83*a*. The same processing is performed on each of a second, third and the following sheets, and the plurality of sheets of paper is wound around and temporarily held by the evacuation drum 61. And then, as shown in FIGS. 10A and 10B, the evacuation drum 61 is rotated in the counter-winding direction to eject the plurality of sheets of paper at once.

In addition, although not illustrated, as a conveyance method in which the paper that has been fed from the image forming unit 22 to the post-processing device 33 is ejected to the main tray 35 and the like without reversing, the following conveyance mode is possible instead of the first conveyance mode. In other words, the evacuation drum 61 is rotated in the winding direction as in FIGS. 7A, 7B and 8A, to thereby temporarily wind the paper around the evacuation drum 61. And then, as in FIG. 5, the branching guide 63 is in the posture 33 and the evacuation drum 61 further rotates in the winding direction to eject the paper.

In this conveyance mode, the paper is temporarily wound around the evacuation drum 61 and ejected in one turn. Therefore, it takes longer than in the first conveyance mode, from introduction of paper into the post-processing device 33 to ejection therefrom. However, in comparison with the fourth conveyance mode according to the present embodiment, the conveyance modes take almost the same amount of time and consistency in paper conveyance timing is favorable. Given this, a conveyance mode performing continuous paper conveyance processing can be configured by combining these conveyance modes. This conveyance mode can provide an effect of allowing mixed ejection of face-up ejection and face-down ejection, in which only some of sheets are conveyed face-up (reversed conveyance) and other sheets are conveyed face-down (normal conveyance), in a single paper conveyance operation.

INDUSTRIAL APPLICABILITY

The present disclosure is generally useful in a device in which reversed conveyance of a sheet-shaped matter, such as paper, is required, and not limited to an image forming apparatus.

The invention claimed is:

1. A post-processing device comprising: an evacuation drum that is rotatably supported by a main shaft and rotates in a first direction to wind a sheet-shaped body around a peripheral surface thereof;

a first branching guide that has a substantially triangle shape of which base faces the drum, and is rotatably supported at a position more on outside than the base in a radial direction of the evacuation drum by a shaft parallel to the main shaft, in which an apex of the first branching guide on an upstream side in a winding direction of the evacuation drum and an apex of the first branching guide on a downstream side in the winding direction of the evacuation drum can be in contact with and separated from the peripheral surface of the evacuation drum by rotation of the first branching guide, the first branching guide forming a gap from the evacuation drum through which the sheet-shaped body can pass when the apexes are separated from the peripheral surface of the evacuation drum;

a first driving unit that rotationally moves the first branching guide and rotates the evacuation drum; and a control unit, wherein, in response to an instruction to reverse the sheet-shaped body, the control unit controls the first driving unit such that:

the gap is formed between the first branching guide and the evacuation drum;

the evacuation drum rotates in the winding direction;

the sheet-shaped body passes through the gap and is wound around the evacuation drum;

the apex of the first branching guide on the downstream side in the winding direction is in contact with the peripheral surface of the evacuation drum;

the evacuation drum rotates in a counter-winding direction;

the sheet-shaped body is separated from the evacuation drum; and the sheet-shaped body is ejected with a face, which is opposite to a top face upon winding, directed upward, along a side other than the base face of the first branching guide, in which the side forms an angle with the base face at the apex of the first branching guide on the downstream side in the winding direction, and wherein, in response to an instruction of ejection without reversing the sheet-shaped body, the control unit controls the first driving unit such that:

the evacuation drum rotates in the winding direction;

the apex of the first branching guide on the upstream side in the winding direction is in contact with the peripheral surface of the evacuation drum;

the sheet-shaped body is separated from the evacuation drum; and the sheet-shaped body is ejected from the conveyance path that is the same as the conveyance path, along another side other than the base face of the first branching guide, in which the side forms another angle with the base face at the apex of the first branching guide on the upstream side in the winding direction, such that a face of the sheet-shaped body in contact with the peripheral surface of the evacuation drum is directed upward.

2. The post-processing device according to claim 1 further comprising:

a processing unit for the sheet-shaped body;

a second branching guide for guiding the sheet-shaped body to the processing unit that has a substantially triangle shape of which base faces the drum, and is rotatably supported at a position more on outside than the base of the second branching guide in a radial direction of the evacuation drum by a shaft parallel to the main shaft, in which an apex of the second branching guide on an upstream side in the winding direction of the evacuation drum can be in contact with and separated from the peripheral surface of the evacuation drum by rotation of the second branching guide, the second branching guide forming a gap from the evacuation drum through which the sheet-shaped body can pass when the apex of the second branching guide on an upstream side is separated from the peripheral surface of the evacuation drum; and a second driving unit that rotationally moves the second branching guide, wherein the control unit, in response to an instruction to reverse the sheet-shaped body, controls the first driving unit and the second driving unit such that:

the gaps are formed between the first branching guide and the evacuation drum and between the second branching guide and the evacuation drum;

the evacuation drum rotates in the winding direction;

the sheet-shaped body passes through the gaps and is wound around the evacuation drum;

the apex of the first branching guide on the downstream side in the winding direction is in contact with the peripheral surface of the evacuation drum;

the evacuation drum rotates in a counter-winding direction;

the sheet-shaped body is separated from the evacuation drum; and the sheet-shaped body is ejected with a face, which is opposite to a top face upon winding, directed upward.

3. The post-processing device according to claim 2, wherein: the post-processing device is connected to an image forming apparatus that forms an image on the sheet-shaped body; and the sheet-shaped body is fed to the post-processing device from the image forming apparatus.

4. The post-processing device according to claim 2, wherein the processing unit for the sheet-shaped body has a function of stapling a stack of a plurality of sheet-shaped bodies.

5. The post-processing device according to claim 1, wherein: the post-processing device is connected to an image forming apparatus that forms an image on the sheet-shaped body; and the sheet-shaped body is fed to the post-processing device from the image forming apparatus.

* * * * *